US006181315B1

(12) United States Patent
Kao

(10) Patent No.: US 6,181,315 B1
(45) **Date of Patent: *Jan. 30, 2001**

(54) MAGNETICALLY OPERATED DISPLAY

(75) Inventor: Pin-Chi Kao, Taipei Hsien (TW)

(73) Assignee: Lite Vision Corporation of Taiwan (TW)

( * ) Notice: Under 35 U.S.C. 154(b), the term of this patent shall be extended for 0 days.

This patent is subject to a terminal disclaimer.

(21) Appl. No.: 09/500,647

(22) Filed: Feb. 9, 2000

Related U.S. Application Data

(63) Continuation of application No. 09/266,981, filed on Mar. 12, 1999, now Pat. No. 6,025,825, which is a continuation of application No. 08/721,060, filed on Sep. 26, 1996, now Pat. No. 5,898,418, which is a continuation-in-part of application No. 08/399,374, filed on Mar. 6, 1995, now abandoned.

(51) Int. Cl.[7] ..... G09G 3/34

(52) U.S. Cl. ..... 345/108; 345/111; 40/449; 340/815.62

(58) Field of Search ..... 345/108, 111, 345/110, 46, 82; 40/446, 449; 340/815.62

(56) References Cited

U.S. PATENT DOCUMENTS

| | | | | |
|---|---|---|---|---|
| 1,191,023 | | 7/1916 | Naylor . | |
| 3,295,238 | | 1/1967 | Winrow | 40/28 |
| 3,942,274 | | 3/1976 | Winrow | 40/28 |
| 4,531,318 | | 7/1985 | Chang et al. | 40/449 |
| 4,654,629 | * | 3/1987 | Bezos et al. | 340/87 |
| 4,761,905 | * | 8/1988 | Black | 40/447 |
| 5,022,171 | | 6/1991 | Norfolk et al. | 40/447 |
| 5,463,827 | | 11/1995 | Williams | 40/449 |
| 5,898,418 | | 4/1999 | Kao | 345/108 |
| 5,909,971 | | 6/1999 | Tijanic | 40/449 |
| 6,025,825 | * | 2/2000 | Kao | 345/108 |

FOREIGN PATENT DOCUMENTS

| | | |
|---|---|---|
| 1014380 | 8/1961 | (GB) . |
| 1468322 | 3/1977 | (GB) . |

* cited by examiner

*Primary Examiner*—Vijay Shankar
*Assistant Examiner*—Mansour M. Said
(74) *Attorney, Agent, or Firm*—Thompson & Knight, L.L.P.; Peter J. Thoma

(57) ABSTRACT

A method of operating a magnetically operated display unit that includes a frame of a color, a plate pivotably mounted on the frame which includes a first surface of a color different from that of the frame and a second surface of a color identical to that of the frame, a magnet embedded in the plate, a U-shaped ferromagnetic element mounted on the frame so that two tips of the magnet are located between two tips of the U-shaped ferromagnetic element, a solenoid mounted on the U-shaped ferromagnetic element and a light emitting diode mounted on the frame. The plate contains a cutout designed for receiving the light emitting diode and one of the tips of the U-shaped ferromagnetic element. The tip of the light emitting diode is located on a level between the plate and the tips of the U-shaped ferromagnetic element. The light emitting diode is visible sufficiently above the surface of the plate so that its light can shine on that surface. In the method of operation, two opposite currents are selectively directed through the solenoid to pivot the plate between opposite positions revealing its different colored sides and revealing or concealing the light emitting diode.

20 Claims, 1 Drawing Sheet

MAGNETICALLY OPERATED DISPLAY

This application is a Continuation of U.S. Ser. No. 09/266,981, filed Mar. 12, 1999 now U.S. Pat. No. 6,025, 825, which in turn is a Continuation of U.S. Ser. No. 08/721,060, filed Sep. 26, 1996 now U.S. Pat. No. 5,898, 418, which in turn is a Continuation-In-Part of U.S. Ser. No. 08/399,374, filed Mar. 6, 1995 now abandened.

BACKGROUND OF THE INVENTION

This invention relates to a magnetically operated display and its method of operation.

Eye-catching displays are becoming more and more popular due to increasing consumerism and the desire for public awareness of products, public announcements, etc.

A first conventional display includes a matrix of light emitting diodes (LEDs) wherein various groups of the LEDs in the matrix can be selectively turned on simultaneously to present various images. The first conventional display performs well in an environment with a low level of light. However, the efficiency of the first conventional display is considerably reduced if the level of light is increased, for example, a sunny day, and the noticeability of the display is impaired.

A second conventional display includes a matrix of magnetically operated display units each including a magnet embedded in a pivotable plate including a first surface with a color different from that of the remaining portion thereof and a second surface with a color identical to that of the remaining portion thereof. The second surfaces of different groups of the pivotable plates in the matrix are selectively exposed to view so as to show different images. The second conventional display shows clear images in a bright environment, however, visibility of the first surfaces of the pivotable plates is greatly reduced in the dark as the first surfaces of the plates do not produce light.

SUMMARY OF THE INVENTION

It is the primary objective of this invention to provide a method for operating a magnetically operated display unit which presents clear images in the darkness or in bright sunlight.

The magnetically operated display unit includes a frame with a color, a plate pivotably mounted on the frame and including a first surface with a color different to that of the frame and a second surface with a color identical to that of the frame, a magnet embedded in the plate, a U-shaped ferromagnetic element mounted on the frame so that two tips of the magnet are located between two tips of the U-shaped ferromagnetic element, a solenoid mounted on the U-shaped ferromagnetic element and a light emitting diode, or other light emitting device, mounted on the frame. The plate defines a cutout for receiving the light emitting diode and one of the tips of the U-shaped ferromagnetic element. The light emitting diode includes a tip located on a level between the plate and the tips of the U-shaped ferromagnetic element. Two opposite currents are selectively directed through the solenoid. The plate is pivotally mounted on axle(s) and the plate is thereby divided into two opposed areas, one on each side of the line of the axle(s). The light emitting diode is disposed in one of these opposed areas, preferably remotely spaced from the line of the axle(s). A lens is disposed above the top of the light emitting element (LED) so that light is cast upon the surface(s) of the plate even under low light conditions.

DETAILED DESCRIPTION OF THE DRAWINGS

Figure 1:
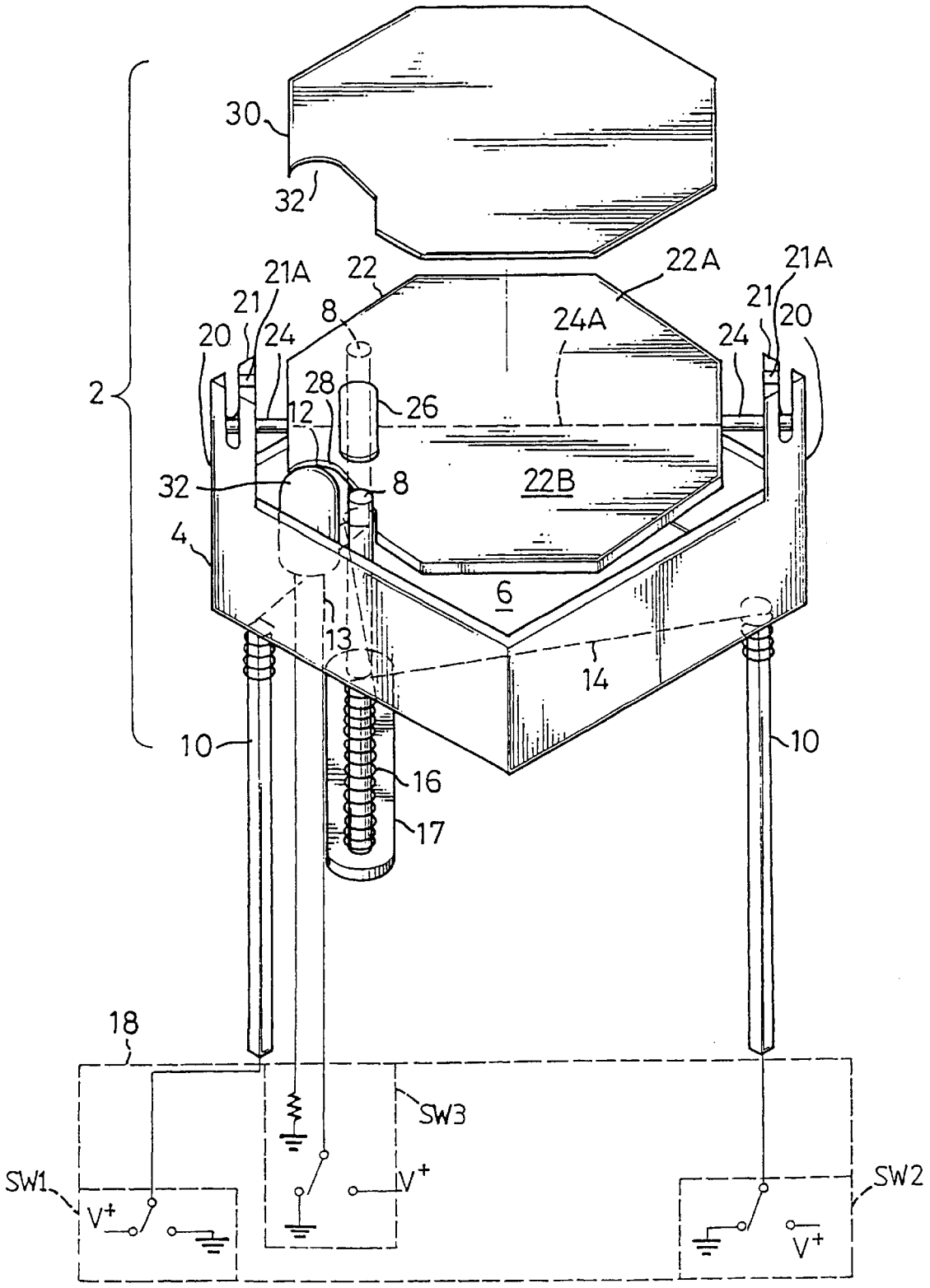
FIG. 1 is a perspective view of a magnetically operated display.

FIG. 1 shows a magnetically operated display unit according to this invention.

Referring to this drawing, the display unit 2 includes a frame 4 including a base 6 defining five apertures (not shown). Two ferromagnetic rods 8, two ferromagnetic pins 10 and a light emitting diode (LED), or other light emitting source, 12 are correspondingly inserted through the apertures defined in the base 6. Each of the ferromagnetic rods 8 includes a lower tip and an upper tip. The light emitter 12 includes two leads 13. A wire 14 is sequentially wound around the ferromagnetic rods 8 so that a solenoid 16 is formed on each of the ferromagnetic rods 8. The wire 14 includes two ends each soldered to a corresponding one of the ferromagnetic pins 10. The lower tips of the ferromagnetic rods 8 are linked to each other by means of a ferromagnetic strip 17 so that the ferromagnetic rods 8 and the ferromagnetic strip 17 form a U-shaped ferromagnetic element. Each of the ferromagnetic pins 10 can be inserted into a socket (not shown) so that the magnetically operated display unit can be connected with a circuit 18. The light emitter 12 is also connected with the circuit 18.

Two arms 20 project upwardly from the frame 4. Two fingers 21 project upwardly from each of the arms 20. Each of the fingers 21 includes an inner face 21A opposite to the other finger 21. A bulbous portion is formed on the inner face of each of the fingers 21 near the tip thereof thereby defining a narrow entrance to a recess defined between the two fingers.

A plate 22 includes a color identical to that of the frame 4. Two axles, or a single long axle, 24 project from the plate 22 in two opposite directions. Each of the axles 24 extends past the tips of the fingers 21 projecting from a corresponding one of the arms 20 so that each of the axles 24 is retained between the fingers 21 projecting from a corresponding one of the arms 20. Thus, the plate 22 is pivotably mounted on the frame 4.

The line 24A of the axle(s) 24 causes the plate 22 to be separated into two areas, 22A and 22B. The light emitting source 12 is suitably disposed in one of these areas, 22B, and is preferably disposed in said area 22B remotely from the line of the axle(s) 24A. The plate 22 contains a defined cutout 28 through which the upper tip of one of the ferromagnetic rods 8 and the light emitting element or source (LED) 12 are inserted. Suitably, a lens 32 is disposed above the light emitting source 12 so that light shines on the plate surface, and thus gives the plate surface visibility, even under low light conditions. In a preferred embodiment of this invention, the top of the lens is disposed between at least about 0.3 mm up to about 3 mm above the plane of the composite plate-reflector surface upon which it shines light.

A magnet 26 includes a north pole at one of its ends and a south pole at its opposite end. The magnet 26 is embedded in the plate 22. The ends of the magnet 26 are located between, and in line with, the upper tips of the ferromagnetic rods 8.

A reflector 30 is preferably of a color that is different from the inherent color of the plate 22. The reflector 30 is suitably adhered to the plate 22 so that the composite thus formed has the color of the reflector on one side. The reflector 30 has a cutout 32 defined therein through which the upper tip of one of the ferromagnetic rods 8 and the light emitter 12 protrude. The reflector 30 conforms in profile to the plate 22.

The circuit 18 includes a first switch SW1, a second switch SW2 and third switch SW3. The first switch SW1 is connected with one end of the wire 14. The second switch SW2 is connected with the other end of the wire 14. The third switch SW3 is connected with the light emitter 12. Each of the switches SW1 and SW2 can be turned between a ground electrode and a positive electrode.

As shown in FIG. 1, the first switch SW1 is turned to the positive electrode and the second switch SW2 is turned to the ground electrode so as to direct a current through the solenoids 16 in a first direction, thus producing a first magnetic field between the upper tips of the ferromagnetic rods 8. Then, both of the switches SW1 and SW2 can be turned to the positive electrode or the ground electrode whilst the first magnetic field remains.

The first switch SW1 can be turned to the ground electrode and the second switch SW2 can be turned to the positive electrode so as to direct a current through the solenoids 16 in a second direction opposite to the first direction, thus producing a second magnetic field between the upper tips of the ferromagnetic rods 8. The direction of the first magnetic field is opposite to the direction of the second magnetic field. Then, both of the switches SW1 and SW2 can be turned to the positive electrode or the ground electrode whilst the second magnetic field remains.

As mentioned above, the first magnetic field or the second magnetic field is produced between the upper tips of the ferromagnetic rods 8, therefore the plate 22 to which the magnet 26 is attached is turned between two opposite positions. In one position, the inherent color of the plate is upwardly directed and in the other position, the color of the reflector 30 is upwardly directed.

The third switch SW3 can be turned on so that light emitter 12 is activated and therefore emits light. The light emitter is preferably a light emitting diode, LED, 12 and includes an upper tip which should be located above the level of the composite of the plate 22 and the reflector 30 so that the LED 12 is clearly visible. The upper tip of the light emitter 12 should be located below the upper ends of the ferromagnetic rods 8 so that the composite of the plate 22 and the reflector 30 will not be hindered in being rotated because of the presence of the LED 12 when the composite of the plate 22 and the reflector 30 is pivoted to a position opposite to the position as shown in FIG. 1.

The ferromagnetic rods 8 and the ferromagnetic strip 17 can be replaced with a one-piece U-shaped ferromagnetic element (not shown).

If the magnetically operated display unit 2 is used in a vehicle (not shown), it is usual for a transparent panel (not shown) to be disposed in front of the magnetically operated display unit 2. When the vehicle is driven, there will be friction between air and the transparent panel thus resulting in the build up of a static charge in the transparent panel. The pivoting of the composite of the plate 22 and the reflector 30, when it is in use, results in the build up of a static charge in the magnetically operated display unit 2. The static charge produced in the transparent panel and the static charge produced in the magnetically operated display unit 2 will attract each other and this may cause difficulty in causing the pivoting of the composite of the plate 22 and the reflector 30. Thus, the static charge produced in the magnetically operated display unit 2 should be removed or at least reduced.

In an effort to overcome the adverse effects of these static charge build ups, it has been found to be helpful to add a conductive agent, such as conductive carbon fibers, to the plastic from which the frame 4, the plate 22 and the reflector 30 are made so that frame 4, the plate 22 and the reflector 30 are conductive to a limited extent which is sufficient for releasing the static charge to the leads of the light emitter 12. The static charge will then bleed out through this circuit and will be at least reduced and possibly be eliminated. Conductive carbon fibers are the preferred conductive agent because they add conductivity to the plastic parts in which they are embedded without imparting magnetic properties thereto.

What is claimed is:

1. A magnetically operated display unit comprising:

a colored frame having a base and arms projecting upwardly away from the base;

a plate pivotably supported by the arms and including a first surface of a color different from that of the frame and a second surface of a color like that of the frame, the plate being pivotable between a first position with the first surface facing away from the base to be visible to a viewer and a second position with the second surface facing away from the base to be visible to the viewer;

a magnet attached to the plate, the magnet having ends of opposite magnetic polarity;

first and second ferromagnetic rods projecting upwardly away from the base, each rod having an upper tip, wherein the two ends of the magnet are located between the two upper tips of the ferromagnetic rods, and wherein the plate includes a cutout in a first edge thereof arranged to permit the plate to pivot without the first edge striking the rods;

a light source mounted adjacent to the plate and having a light emitting surface disposed above the level of the first surface of the plate when it is in its first position so that the light emitting surface is visible to the viewer, wherein the light source is alternately adjacent to opposite edges of the plate with the plate either in its first position or in its second position; and a solenoid circuit coupled to the rods and responsive to two opposite currents selectively directed therethrough sufficient to cause the plate to pivot as the magnet responds to magnetic fields of opposite directions between the upper tips of the rods produced by the opposite currents, whereby the first or second surface of the plate is directed away from the base so as to be visible to the viewer.

2. The magnetically operated display unit of claim 1 further comprising a ferromagnetic strip and wherein the ferromagnetic rods have lower tips that are linked together by the ferromagnetic strip to form a U-shaped ferromagnetic element.

3. The magnetically operated display unit of claim 2 wherein the solenoid circuit includes two solenoids, each mounted on a corresponding one of the ferromagnetic rods, the solenoids being portions of a common wire through which the opposite currents are selectively directed.

4. The magnetically operated display unit of claim 1 wherein the plate includes a reflector attached thereto and forming the first surface thereof.

5. The magnetically operated display unit of claim 1 wherein the plate is pivotable about an axis that defines first and second areas of the plate on opposite sides of the axis, the first edge with the cutout being in the first area, a second edge without a cutout being in the second area symmetrically opposite from the cutout, the second edge acting as a stop against movement of the plate by abutting the upper tips of the ferromagnetic rods in the first and second positions.

6. The magnetically operated display unit of claim 1 wherein the light source is an LED mounted on the frame and having an upper tip defining the light emitting surface, the upper tip of the LED extending through the cutout when the plate is in the first position so that the LED is clearly visible with the plate in the first position.

7. The magnetically operated display unit of claim 1 wherein the plate and light source are positioned relative to each other so that the plate when in its second position covers the light emitting surface from view by the viewer.

8. A magnetically operated display unit comprising:

a colored frame having a base, walls projecting upwardly from the base, and arms projecting upwardly from the walls, the walls defining a substantially square space therewithin, the arms being disposed at opposite corners of the substantially square space;

a plate pivotably supported by the arms and including a first surface of a color different from that of the frame and a second surface of a color like that of the frame, the plate being pivotable between a first position with the first surface facing away from the base to be visible to a viewer and a second position with the second surface facing away from the base to be visible to the viewer;

a magnet embedded in the plate, the magnet having ends of opposite magnetic polarity;

first and second ferromagnetic rods projecting upwardly away from the base, each rod having an upper tip, wherein the two ends of the magnet are located between the two upper tips of the ferromagnetic rods, and wherein the plate includes a cutout in a first edge thereof arranged to permit the plate to pivot without the first edge striking the rods;

an LED light source mounted adjacent to the plate and having a light emitting surface disposed within the substantially square space above the level of the first surface of the plate when it is in its first position; and a solenoid circuit coupled to the rods and responsive to two opposite currents selectively directed therethrough sufficient to cause the plate to pivot as the magnet responds to magnetic fields of opposite directions between the upper tips of the rods produced by the opposite currents, whereby the first or second surface of the plate is directed away from the base so as to be visible to the viewer.

9. The magnetically operated display unit of claim 8 further comprising a ferromagnetic strip and wherein the ferromagnetic rods have lower tips that are linked together by the ferromagnetic strip to form a U-shaped ferromagnetic element.

10. The magnetically operated display unit of claim 9 wherein the solenoid circuit includes two solenoids, each mounted on a corresponding one of the ferromagnetic rods, the solenoids being portions of a common wire through which the opposite currents are selectively directed.

11. The magnetically operated display unit of claim 8 wherein the plate includes a reflector attached thereto and forming the first surface thereof.

12. The magnetically operated display unit of claim 8 wherein the plate is pivotable about an axis that defines first and second areas of the plate on opposite sides of the axis, the first edge with the cutout being in the first area, a second edge without a cutout being in the second area symmetrically opposite from the cutout, the second edge acting as a stop against movement of the plate by abutting the upper tips of the ferromagnetic rods in the first and second positions.

13. The magnetically operated display of claim 8 wherein the LED light source is mounted on the frame and having an upper tip defining the light emitting surface, the upper tip of the LED light source extending through the cutout when the plate is in the first position so that the LED is clearly visible with the plate in the first position.

14. The magnetically operated display of claim 8 wherein the light emitting surface of the LED light source is disposed below the level of the plate when it is in its second position.

15. A magnetically operated display unit comprising:

a colored frame having a base and arms projecting upwardly away from the base;

a plate pivotably supported by the arms and including a first surface of a color different from that of the frame and a second surface of a color like that of the frame, the plate being pivotable between a first position with the first surface facing away from the base to be visible to a viewer and a second position with the second surface facing away from the base to be visible to the viewer;

a magnet embedded in the plate, the magnet having ends of opposite magnetic polarity;

first and second ferromagnetic rods projecting upwardly away from the base, each rod having an upper tip, wherein the two ends of the magnet are located between the two upper tips of the ferromagnetic rods, and wherein the plate includes a cutout in a first edge thereof arranged to permit the plate to pivot without the first edge striking the rods;

an LED light source mounted adjacent to the plate and having a light emitting surface disposed above the level of the first surface of the plate when it is in its first position, and disposed below the level of the plate when it is in its second position; and a solenoid circuit coupled to the rods and responsive to two opposite currents selectively directed therethrough sufficient to cause the plate to pivot as the magnet responds to magnetic fields of opposite directions between the upper tips of the rods produced by the opposite currents, whereby the first or second surface of the plate is directed away from the base so as to be visible to the viewer.

16. The magnetically operated display unit of claim 15 further comprising a ferromagnetic strip and wherein the ferromagnetic rods have lower tips that are linked together by the ferromagnetic strip to form a U-shaped ferromagnetic element.

17. The magnetically operated display unit of claim 16 wherein the solenoid circuit includes two solenoids, each mounted on a corresponding one of the ferromagnetic rods, the solenoids being portions of a common wire through which the opposite currents are selectively directed.

18. The magnetically operated display unit of claim 15 wherein the plate includes a reflector attached thereto and forming the first surface thereof.

19. The magnetically operated display unit of claim 15 wherein the plate is pivotable about an axis that defines first and second areas of the plate on opposite sides of the axis, the first edge with the cutout being in the first area, a second edge without a cutout being in the second area symmetrically opposite from the cutout, the second edge acting as a stop against movement of the plate by abutting the upper tips of the ferromagnetic rods in the first and second positions.

20. The magnetically operated display of claim 15 wherein the LED light source is mounted on the frame and having an upper tip defining the light emitting surface, the upper tip of the LED light source extending through the cutout when the plate is in the first position so that the LED is clearly visible with the plate in the first position.

* * * * *